United States Patent [19]

Hickman

[11] 4,071,987

[45] Feb. 7, 1978

[54] GRAVEL STOP

[75] Inventor: John B. Hickman, Asheville, N.C.

[73] Assignee: W. P. Hickman Company, Inc., Asheville, N.C.

[21] Appl. No.: 697,436

[22] Filed: June 18, 1976

[51] Int. Cl.[2] ..... E04D 13/5

[52] U.S. Cl. ..... 52/94; 52/60

[58] Field of Search ..... 52/94, 95, 60

[56] References Cited

U.S. PATENT DOCUMENTS

| | | | |
|---|---|---|---|
| Re. 26,056 | 7/1966 | Hickman | 52/94 |

FOREIGN PATENT DOCUMENTS

| | | | |
|---|---|---|---|
| 2,060,292 | 6/1972 | Germany | 52/60 |
| 1,347,974 | 2/1974 | United Kingdom | 52/94 |

*Primary Examiner*—Alfred C. Perham

*Attorney, Agent, or Firm*—Harness, Dickey & Pierce

[57] ABSTRACT

The gravel stop is made of a springable material which has top and bottom portions joined by a horizontal and a sloping portion disposed therebetween. Since the material has spring characteristics, a fascia having a channel at the top and the bottom may be placed over the top edge and moved downwardly and released to have the bottom channel engage the bottom edge of the spring unit. Adhesive, nails or other attaching means may be employed to secure the spring unit to the material at the roof edge. The spring unit may be made of aluminum, stainless steel, galvanized steel, plastic and the like. A spring unit of galvanized steel was secured by Neoprene Construction Adhesive manufactured by Franklin Glue Co.

12 Claims, 8 Drawing Figures

GRAVEL STOP

BACKGROUND OF THE INVENTION

Reference may be had to U.S. Pat. Nos. 3,719,010 and Re 26,056 as well as the patents cited therein to show treatment for the gravel stop and fascia at the tope edge of a building.

SUMMARY OF THE INVENTION

A spring unit having an aligned or offset vertical top and bottom portion with horizontal and sloping portions disposed therebetween is secured to the top edge of a building to form a gravel stop and a spring support for a fascia member. The horizontal and a depending vertical bottom portion have closely disposed apertures therethrough which receives an adhesive material placed on the top and the outer face of the top masonry edge of the building. The adhesive will be forced through the apertures when the spring unit has the horizontal and vertical bottom portions pressed thereagainst. The adhesive material through the apertures more readily dries so that the spring unit will be secured quickly to the top edge of the building. A roofing layer of elastomeric material or tar paper may extend up the sloping portion and over the edge of the top vertical portion to hang downwardly on the opposite side and be pinched to the edge in sealed relation therewith when the downwardly facing channel at the top edge of the fascia member is engaged therewith. The spring unit is deflected downwardly so that the channel at the bottom of the fascia may engage the outwardly directed flange at the vertical bottom portion of the spring unit. When released, the fascia is secured in position by the spring pressure provided by the spring unit which produces a seal with the layer of roof material. If gravel is employed over the roof material, this may extend up the sloping face as is customary in a gravel stop arrangement. The advantage of this construction is to secure the fascia against movement and to seal the layer of roofing material within the channel at the top edge of the fascia by the force of the spring unit. The spring unit and fascia member are provided in workable lengths, such as 10 feet, and are sealed by a joint cover which has a downwardly presenting channel at the top edge which engages the sheet of roofing material when forced downwardly thereover at the point where a joint will occur. The ends of the fascia member may abut each other or may be spaced a short distance and with the cover extending beneath the edges or with the channel enlarged to extend over the channel at the top of the fascia members.

BRIEF DESCRIPTION OF THE DRAWINGS

FIG. 8 is a view of structure, similar to that illustrated in FIG. 3, showing a fascia with the edge channels vertically offset.

DESCRIPTION OF THE PREFERRED EMBODIMENT

Figure 1:
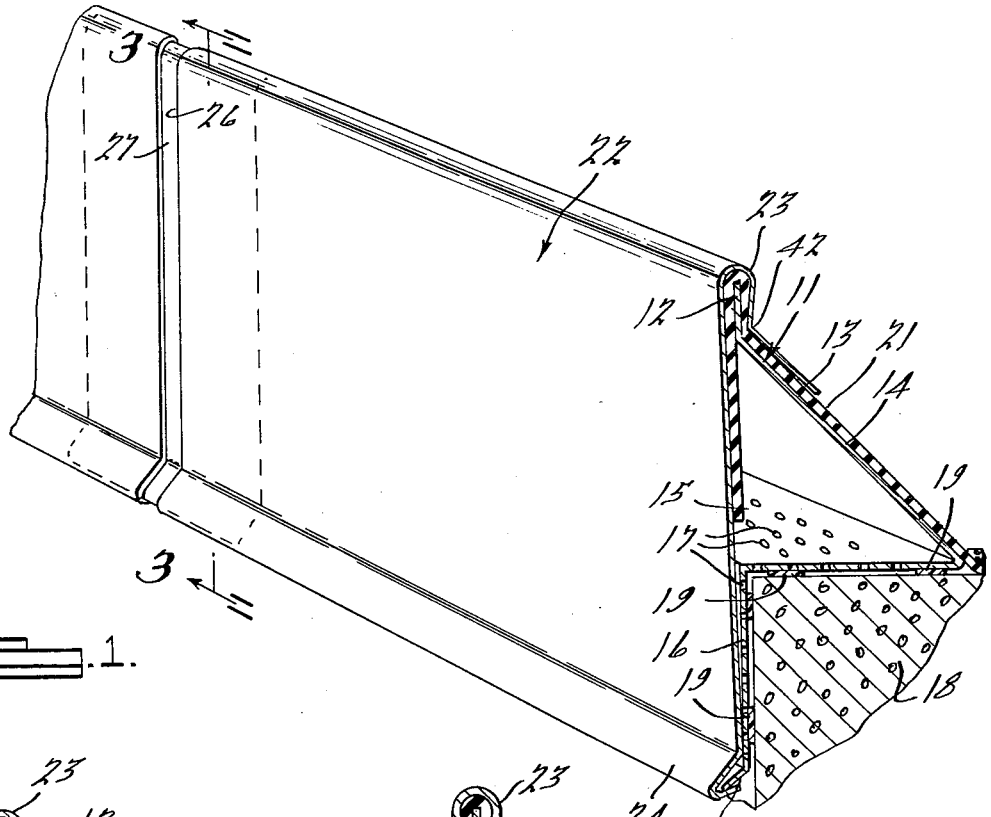
FIG. 1 is a perspective view of a spring unit secured to the top of the masonry of a building to form a gravel stop, a seal for the roofing material and a support for the fascia member in a manner embodying the present invention.
Figure 3:
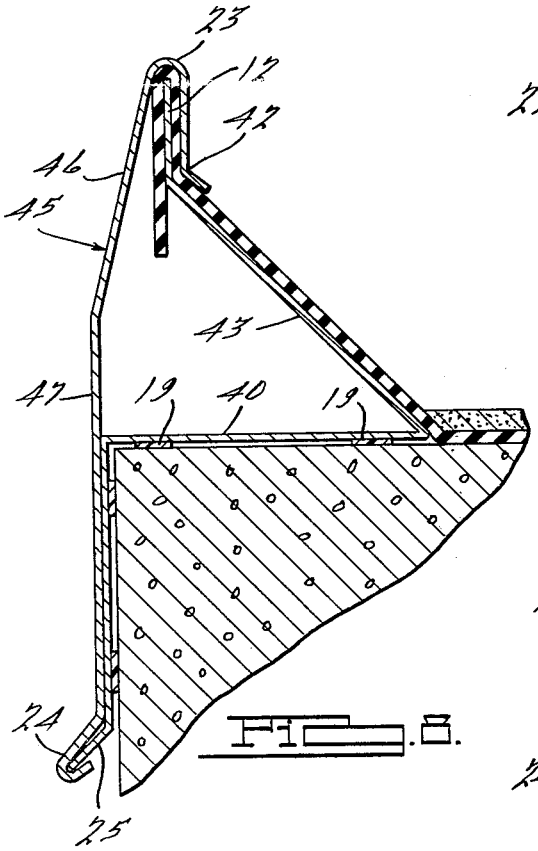
FIG. 3 is a sectional view of the structure illustrated in FIG. 1, taken on the line 3—3 thereof.
Figure 2:
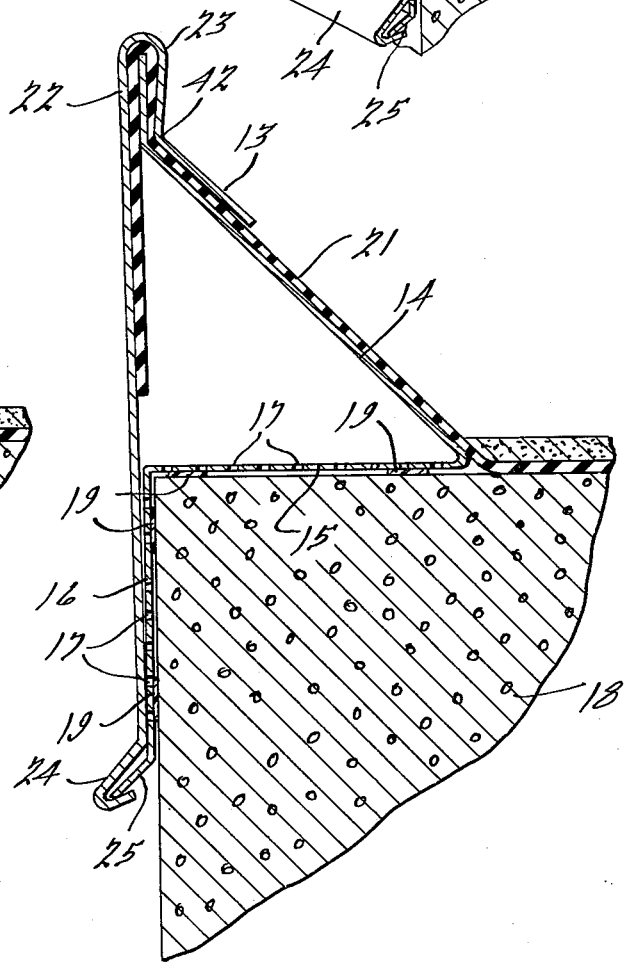
FIG. 2 is an end view of the structure illustrated in FIG. 1, as viewed from the righthand end thereof.
Figure 3:
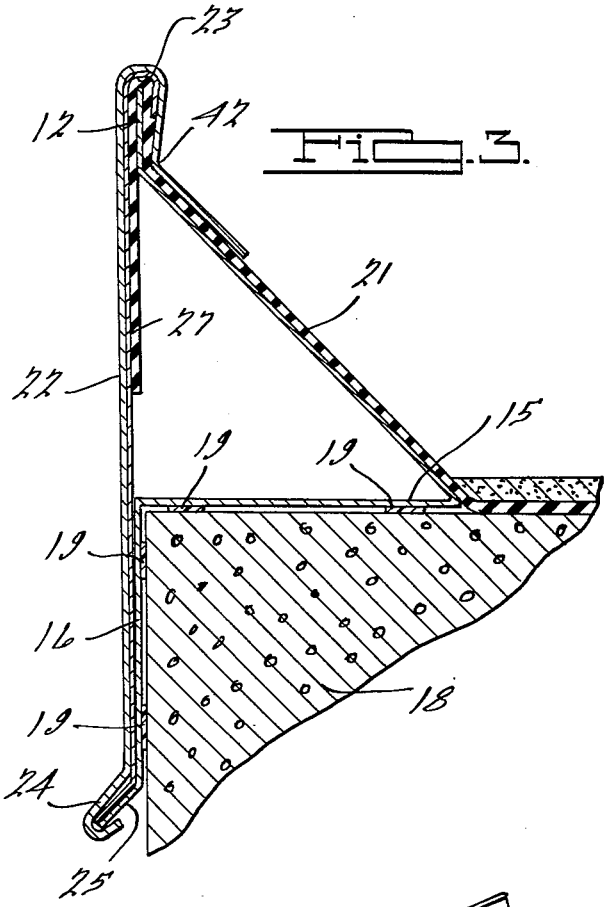

Referring to FIGS. 1, 2 and 3, the spring unit 11 of the present invention embodies a top vertical portion 12, a sloping or angular portion 14, which may be referred to as a gravel stop, a horizontal portion 15 and a bottom vertical portion 16 which is aligned with the top vertical portion 12. The horizontal portion 15 and the bottom vertical portion 16 are provided with small closely disposed apertures 17 which may be adhered to the top and front masonry surface 18 of a building by longitudinally extending beads of an adhesive 19. The adhesive may be applied to a clean masonry surface in strips of approximately $\frac{3}{8}$ inch in diameter. The spring unit 11 has the horizontal portion and bottom vertical portion 15 and 16 forced down and inward against the masonry surface thereby flattening the beads and forcing the glue or adhesive 19 through the apertures 17. The extension of the adhesive through the apertures while providing some additional holding force primarily shortens the time required to set up the adhesive to have the spring unit 11 fixed to the top edge of the building.

A layer 21 of roofing material which may be a resilient plastic or which may be tar paper, as is commonly used, will extend up the sloping face or gravel stop 14 and extend over the top edge of the top vertical portion 12 to hang downwardly toward and sometimes beyond the horizontal portion 15. A fascia member 22 has a downwardly presenting channel 23 at the top edge which extends over the layer of sheet material 21, and the spring unit 11 and fascia member 22 are deflected downwardly to have the inwardly and upwardly presented channel edge 24 engage the outwardly and downwardly sloping flange 25 on the bottom edge of the spring unit 11. When the fascia member is released, it will be moved upwardly by the spring force in the unit 11 to have the channel 24 engage the flange 25 under pressure which will thereby provide a pressure engagement between the top of the unit 11, the edge of the vertical top portion 12 and the downwardly facing channel 23 of the fascia member 22. With this arrangement, the costly screws and the flashing strips are eliminated and a more practical and less costly construction in labor and material is thereby provided.

As illustrated in FIG. 3, where the adjacent ends of the fascia members 22 are abutted or substantially abutted, as illustrated at 26 in FIG. 1 a joint cover 27 is provided which, as illustrated in FIG. 3, has a downwardly directed channel section 28 at the top edge which extends over the layer of roofing material 21 to form a seal therewith. The joint cover 27 extends outwardly to register with the flange 25 on the bottom portion 16 of the spring unit. The joint cover 27 is herein illustrated as being located on the inside of the channel edge 23 at the top of the spaced fascia members 22 but could have its channel section 28 widened to extend over the outside of the channel edge 23 and the adjacent fascia member edges 26.

Figure 4:
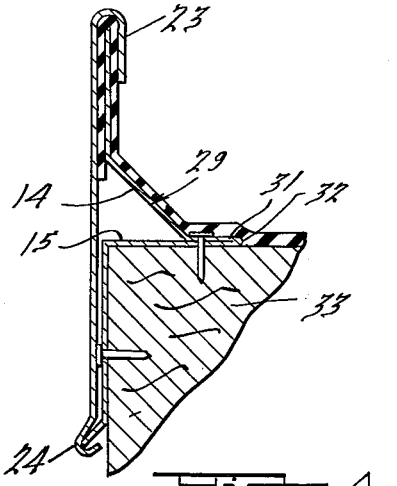
FIG. 4 is a view of structure, similar to that illustrated in FIG. 2, which has the inner portion reversely bent upon itself to form a nailing edge.

In FIG. 4, a spring unit 29 is illustrated wherein the sloping portion 14 and the horizontal portion 15 are flattened at 31 along their adjoining edges 32. This flattened edge forms a nailing strip wherein the entire spring unit 29 is secured to a wood member 33 at the top building edge.

Figure 5:
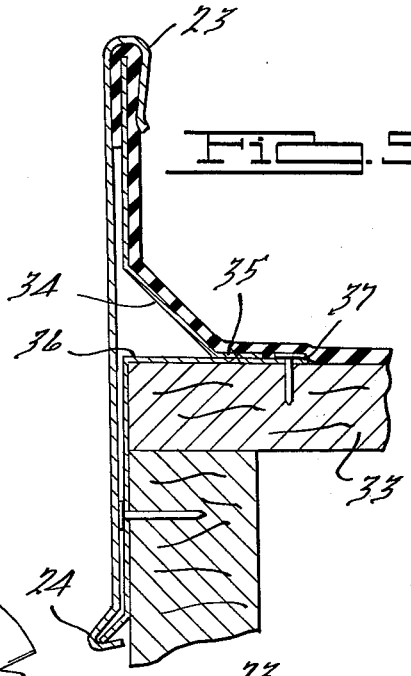
FIG. 5 is a view of structure, similar to that illustrated in FIG. 4, showing a further form of the invention.
Figure 6:
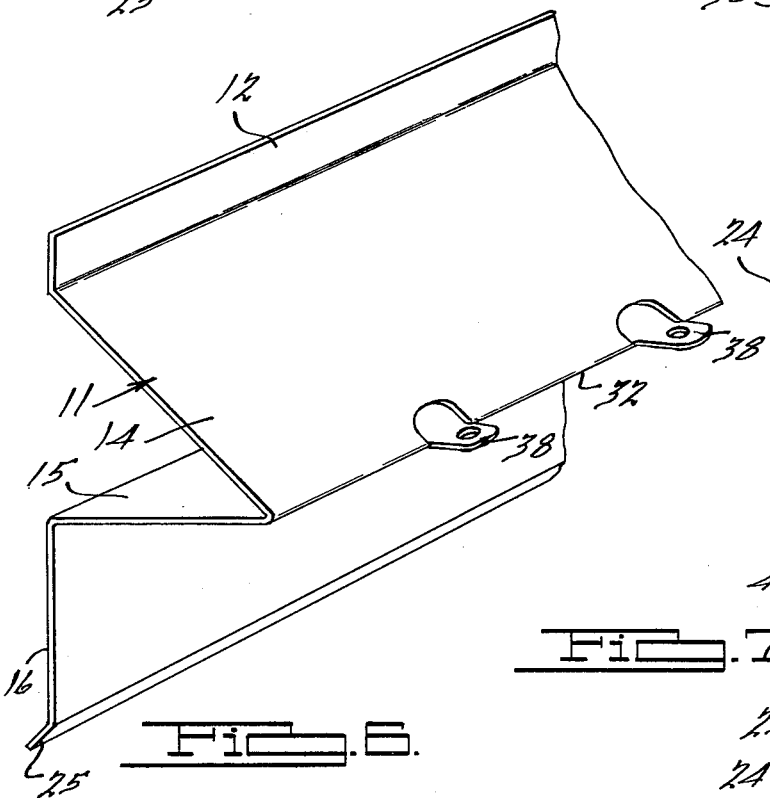
FIG. 6 is a view of structure, similar to that illustrated in FIG. 4, showing struck-out fingers employed for securing the spring unit inwardly of the roof edge.

In FIG. 5, a similar arrangement is provided wherein the sloping portion 34 forms a separate element having a flange 35 which is welded to separate horizontal and bottom vertical portions 36 leaving a nailing edge 37 inwardly thereof.

in FIG. 6, the sloping portion 14 of the structure illustrated in FIGS. 1 to 3 has cut-out fingers 38 along the ajoining edge 32 by which the spring unit 11 is secured to a wood roof member 33 by nails driven through the fingers.

Figure 7:
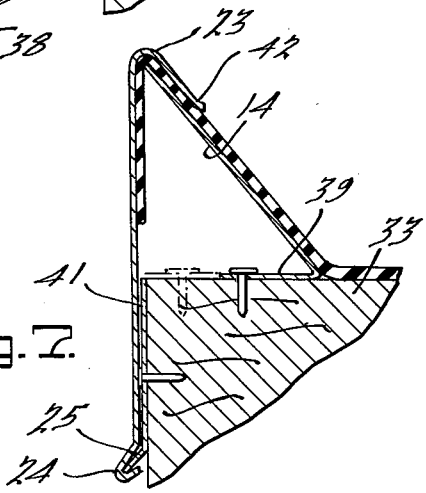
FIG. 7 is a view of a spring unit employing two separate elements which are secured to the roof edge in a manner to provide a spring action for engaging and supporting the fascia member.

In FIG. 7, a two piece spring unit is illustrated that wherein the sloping portion 14 has a reversely bent horizontal portion 39 which is secured by nails to the wood roofing element 33. The element 14 may be provided with a top vertical portion 12 along the upper edge thereof when this is found desirable. A bottom vertical portion 41 is secured by nails to the wood element 33 along the outer edge of the building. The bottom portion 41 has a flange 25 along the bottom edge for receiving the channel portion 24 of the fascia member. It will be noted that the two portions 39 and 41 may be joined together in unit relation as indicated in dot and dash line so that a unit construction could be followed.

In FIG. 8, a spring unit is illustrated which is the same as that shown in FIG. 2 with the exception that the sloping portion 43 is foreshortened to provide a top vertical portion 12 which is offset from the vertical portion 16 at the bottom. The fascia member 45 has the top downwardly presenting channel 23 offset from the bottom channel 24 providing a vertical portion 47 and a sloping portion 46 which aligns the channel elements 23 and 24 with the vertical top and bottom offset portions of the spring unit.

It will be noted in all of the arrangements that the top channel portion will seal the layer of roof material 21 when it extends over the top edge of the top vertical portion 12 with an additional seal provided at the top of the sloping portion or gravel stop 43 by a bend in the inner flange of the fascia channel element 23 along the line 42. An upper pressure will be provided between the top vertical portion 2 and the bottom vertical portion 16 which will aid in sealing the layer of material 21 at the top of the top vertical portion. This bias also fixedly secures the fascia member in position at the top edge of the roof.

In all of the constructions the resiliency of the spring unit provides a seal between the layer of roofing material and the top edge of the fascia member. The engagement of the flange along the line 42 with the layer of material 21 provides further assurance that a seal will be maintained between the material 21 and the spring unit. The channel element 23 of the fascia member provides a seal along the line 42 thereof and also at the top edge of the spring unit over which the layer of material 21 extends. While the roofing material is preferably made of a layer of elastomeric material, it may be covered with a layer of gravel or be treated with an aluminum paint. It is to be understood that a galvanized metal sheet may be employed to construct the spring unit 11 and the single-ply roofing material 21 may be a thick sheet of synthetic elastomeric material such as vinyl. Besides the galvanized steel, aluminum, stainless steel, plastic and the like, any other flexible spring material may be utilized in the construction of the spring unit 21.

What is claimed is:

1. In a spring unit forming a gravel stop at the edge of a roof made of a sheet of spring material having vertical, horizontal and angular portions forming a spring unit with top and bottom edges, means for supporting the unit along the edge of a roof on the horizontal portion with the vertical portion extending downwardly therefrom, the top of the angular portion being moved downwardly when the angular portion is deflected, and flat fascia members having channel elements along the top and bottom edges which face in opposite directions toward each other, the top and bottom edges of the spring unit extend within said channel elements when the angular portion of the spring unit is deflected downwardly and released to have the top and bottom edges thereof enter the facing channel elements at the top and bottom edges of the fascia members which are supported thereby.

2. In a spring unit as recited in claim 1, wherein the spring unit provides a bias between the top channel element of the fascia member and roofing material extending over the top edge of the spring unit when in substantially vertical position to form a seal therebetween.

3. In a spring unit construction as recited in claim 2, wherein the inner side of the channel element at the top edge of the fascia member is deflected outwardly between the top and bottom edges thereof to provide a line of engagement with roofing material extending up over the angular portion of the spring unit to provide a further seal therefor.

4. In a spring unit construction as recited in claim 1, wherein the holding means for the spring unit at the edge of the roof is an adhesive material.

5. In a spring unit construction as recited in claim 1, wherein the securing means for the spring unit is a flattened edge between the horizontal and angular portions of the spring unit through which nails are driven.

6. In a spring unit construction as recited in claim 1, wherein a plurality of fingers struck from the angular portion of the spring unit located in the plane of the horizontal portion have nails driven therethrough for securing the spring unit to the edge of the roof.

7. In a spring unit construction as recited in claim 4, wherein the horizontal and vertical bottom portions of the spring unit are provided with a plurality of apertures through which the adhesive material extends.

8. In a spring unit construction as recited in claim 1, wherein the spring unit is made from two parts, one having angular and horizontal portions, and the other a bottom vertical portion on the forward edge of the horizontal portion which are secured to the roof edge, the edges of the upper angular and lower vertical portions being engaged by the channel elements at the top and bottom of the fascia members into which they extend.

9. In a spring unit construction as recited in claim 9, wherein the horizontal and angular portions of the unit are welded or otherwise secured together when separately formed.

10. In a spring unit construction as recited in claim 1, wherein a top flange for the unit extends up from the top of the angular portion, and a bottom portion of the unit constituting said vertical portion extends downward from the free edge of the horizontal portion, the top flange and bottom portion being engaged by the top and bottom channel elements of said fascia members into which they extend to provide support therefor.

11. In a spring unit construction as recited in claim 10, wherein the top and bottom portions of the unit are in aligned relation for supporting fascia members having a plane surface.

12. In a spring unit construction as recited in claim 10, wherein the top and bottom portions of the unit are in offset relation for supporting fascia members having upper and lower surfaces in angular relation to each other.

* * * * *

REEXAMINATION CERTIFICATE (214th)

United States Patent [19]

Hickman

[11] B1 4,071,987

[45] Certificate Issued Jul. 3, 1984

[54] GRAVEL STOP

[75] Inventor: John B. Hickman, Asheville, N.C.

[73] Assignee: W. P. Hickman Company, Inc., Asheville, N.C.

Reexamination Request:
No. 90/000,288, Nov. 10, 1982

Reexamination Certificate for:

| | |
|---|---|
| Patent No.: | **4,071,987** |
| Issued: | **Feb. 7, 1978** |
| Appl. No.: | **697,436** |
| Filed: | **Jun. 18, 1976** |

[51] Int. Cl.[3] ..... E04D 13/05
[52] U.S. Cl. ..... 52/94; 52/60
[58] Field of Search ..... 52/60, 94

[56] References Cited

U.S. PATENT DOCUMENTS

| | | | |
|---|---|---|---|
| Re. 26,056 | 7/1966 | Hickman | 52/94 |
| 164,602 | 6/1975 | Shepard . | |
| 674,379 | 5/1901 | Hard . | |
| 1,299,425 | 4/1919 | Carpenter . | |
| 1,337,840 | 4/1920 | Hawley . | |
| 1,740,753 | 12/1929 | Vallas . | |
| 1,782,246 | 11/1930 | Schneider . | |
| 2,136,122 | 11/1938 | Almdale . | |
| 2,160,758 | 6/1939 | Shurman . | |
| 2,219,992 | 10/1940 | Hanson . | |
| 2,250,548 | 7/1941 | Ness . | |
| 2,554,779 | 5/1951 | Goodwin . | |
| 2,734,602 | 2/1956 | Dawson . | |
| 2,755,484 | 7/1956 | Hotz . | |
| 2,793,403 | 5/1957 | Livingston | 52/366 |
| 2,855,776 | 10/1958 | Trostle . | |
| 2,857,861 | 10/1958 | Trostle . | |
| 2,920,477 | 1/1960 | Shaw . | |
| 3,012,376 | 12/1961 | Reddy et al. . | |
| 3,024,573 | 3/1962 | McKinley . | |
| 3,090,161 | 5/1963 | Edwards . | |

(List continued on next page.)

FOREIGN PATENT DOCUMENTS

| | | | |
|---|---|---|---|
| 603078 | 8/1960 | Canada . | |
| 1509147 | 11/1969 | Fed. Rep. of Germany . | |
| 1918761 | 10/1970 | Fed. Rep. of Germany . | |
| 1659340 | 1/1971 | Fed. Rep. of Germany . | |
| 1933004 | 1/1971 | Fed. Rep. of Germany . | |
| 2060292 | 6/1972 | Fed. Rep. of Germany | 52/60 |
| 2118981 | 10/1972 | Fed. Rep. of Germany . | |
| 2234975 | 2/1974 | Fed. Rep. of Germany . | |
| 2316266 | 10/1974 | Fed. Rep. of Germany . | |
| 2335223 | 1/1975 | Fed. Rep. of Germany . | |
| 1128360 | 8/1956 | France . | |
| 7610357 | 4/1977 | Netherlands . | |
| 7432 | 3/1911 | United Kingdom . | |
| 1024071 | 3/1966 | United Kingdom . | |
| 1104027 | 2/1968 | United Kingdom . | |
| 1180965 | 2/1970 | United Kingdom . | |
| 1203344 | 8/1970 | United Kingdom . | |
| 1347974 | 2/1974 | United Kingdom | 52/94 |

OTHER PUBLICATIONS

Alcoa catalog page entitled "Type JJ" gravel stop.

MM Systems Corporation catalog page entitled "Drip--Proof Fascia and Cant Dam Systems, F-Series".

Fascias Incorporated sales catalog page entitled "Master-Edge Extruded Aluminum Fascia".

Pomar Building Products, Inc. sales sheet regarding "HiLite Fascia A".

Braas & Co. GmbH brochure entitled "PVC Flat-roof Systems", (date unknown), 10 pages.

Braas Systems, Inc. brochure number 1004NA, entitled "Purpose-made Accessories for Braas Flat Roofs", dated 1/81 and 7/79, 10 pages.

*Primary Examiner*—Alfred C. Perham

[57] ABSTRACT

The gravel stop is made of a springable material which has top and bottom portions joined by a horizontal and a sloping portion disposed therebetween. Since the material has spring characteristics, a fascia having a channel at the top and the bottom may be placed over the top edge and moved downwardly and released to have the bottom channel engage the bottom edge of the spring unit. Adhesive, nails or other attaching means may be employed to secure the spring unit to the material at the roof edge. The spring unit may be made of aluminum, stainless steel, galvanized steel, plastic and the like. A spring unit of galvanized steel was secured by Neoprene Construction Adhesive manufactured by Franklin Glue Co.

U.S. PATENT DOCUMENTS 3,237,352 3/1966 Edwards .
3,389,515 6/1968 Hellebrand .
3,405,485 10/1968 Edwards .
3,415,020 12/1968 Windle .
3,444,658 5/1969 Gobel .
3,447,273 6/1969 Thom .
3,488,902 1/1970 Gobel .
3,503,162 3/1970 Ward .
3,533,201 10/1970 Tyler .
3,571,992 3/1971 Comiskey .
3,608,255 9/1971 Chomes .
3,624,973 12/1971 Attaway .
3,668,811 6/1972 Pollard .
3,696,575 10/1972 Armstrong .
3,712,003 1/1973 Hallock et al. .
3,719,010 3/1973 Hickman .
3,731,439 5/1973 Hickman .
3,742,668 7/1973 Oliver .
3,802,140 4/1974 Hickman .
3,812,634 5/1974 Resech .
4,037,372 7/1977 Patry ..... 52/96
4,241,549 12/1980 Hall, III et al. .

REEXAMINATION CERTIFICATE ISSUED UNDER 35 U.S.C. 307.

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 3, lines 43–54:

It will be noted in all of the arrangements that the top channel portion will seal the layer of roof material 21 when it extends over the top edge of the top vertical portion 12 with an additional seal provided at the top of the sloping portion or gravel stop 43 by a bend in the inner flange of the fascia channel element 23 along the line 42. An upper pressure will be provided between the top vertical portion [2] *12* and the bottom vertical portion 16 which will aid in sealing the layer of material 21 at the top of the top vertical portion. This bias also fixedly secures the fascia member in position at the top edge of the roof.

AS A RESULT OF REEXAMINATION, IT HAS BEEN DETERMINED THAT:

Claims 1 and 9 are determined to be patentable as amended:

Claims 2–8 and 10–12, dependent on amended claims, are determined to be patentable.

New claims 13–15 are added and determined to be patentable.

1. In a spring unit forming a gravel stop at the edge of a roof, *said spring unit being* made of a sheet of spring material having vertical, horizontal and angular portions forming a spring unit with top and bottom edges, means for supporting the *spring* unit along the edge of a roof on the horizontal portion with the vertical portion extending downwardly therefrom, the top *edge* of the angular portion being moved downwardly when the angular portion is deflected, and *a generally* flat fascia member[s] having channel elements along the top and bottom edges which face in opposite directions toward each other, the top and bottom edges of the spring unit [extend] *extending* within said channel elements when the angular portion of the spring unit is deflected downwardly and released to have the top and bottom edges thereof enter the facing channel elements at the top and bottom edges of [the] *said* fascia [members] *member* which [are] *is* supported thereby[.], *said top channel element of said fascia member being resiliently biased by said angular portion of spring unit in a generally inward direction relative to said vertical portion and a generally upward direction relative to said horizontal portion, and said bottom channel element of said fascia member being resiliently biased by said vertical portion of said spring unit in a generally inward direction relative to vertical portion and a generally downward direction relative to said horizontal portion when said fascia member is installed on said spring unit.*

9. In a spring unit construction as recited in claim [9] *8*, wherein the horizontal and angular portions of the unit are welded or otherwise secured together when separately formed.

*13. The invention according to claim 1, wherein said vertical portion of said spring unit includes a resilient flange portion extending therefrom in a generally outward direction relative to said vertical portion and a generally downward direction relative to said horizontal portion, said downwardly and outwardly extending flange resiliently and forcibly biasing said bottom channel element of said fascia member in said generally inward and downward directions.*

*14. The invention according to claim 13, wherein said vertical portion of said spring clip is adapted to be positioned in a generally flush relationship with a vertical face of the roof structure, said downwardly and outwardly extending flange of said spring clip sloping away from said vertical face to accommodate said generally flush relationship.*

*15. The invention according to claim 2, wherein said roofing material extends over the top edge of said angular portion of said spring unit between said spring unit and said fascia member, said top channel element of said fascia member resiliently and forcibly pinching said roofing material therein in order to forcibly grip and seal said roofing material against the top edge portion of said spring clip.*

* * * * *